United States Patent [19]

Matsumura et al.

[11] 3,984,898

[45] *Oct. 12, 1976

[54] MULTILAYER FIBROUS STRUCTURES

[75] Inventors: Hisashi Matsumura; Tadanori Samejima; Hiroshi Orito; Hisashi Ochiai, all of Shizuoka, Japan

[73] Assignee: Honshu Paper Company, Ltd., Tokyo, Japan

[ * ] Notice: The portion of the term of this patent subsequent to Dec. 25, 1990, has been disclaimed.

[22] Filed: Dec. 21, 1973

[21] Appl. No.: 427,145

Related U.S. Application Data

[63] Continuation-in-part of Ser. No. 262,185, June 13, 1972, Pat. No. 3,781,150.

[30] Foreign Application Priority Data

Dec. 29, 1971 Japan ..... 47-1229

[52] U.S. Cl. ..... 19/156.3; 19/94

[51] Int. Cl.[2] ..... D01G 25/00

[58] Field of Search ..... 19/155, 156–156.4, 19/94, 82; 156/62.2, 62.4; 425/80, 81, 82, 83; 241/49

[56] References Cited

UNITED STATES PATENTS

| | | | |
|---|---|---|---|
| 708,133 | 9/1902 | Franke | 19/94 |
| 2,646,381 | 7/1953 | Duvall | 19/156.3 X |
| 2,807,054 | 9/1957 | Burger et al. | 19/156.3 |
| 2,993,239 | 7/1961 | Heritage | 19/156.3 |
| 3,034,180 | 5/1962 | Greiner et al. | 19/156.3 X |
| 3,740,797 | 6/1973 | Farrington | 19/156.3 |
| 3,781,150 | 12/1973 | Matsumura et al. | 425/80 |

FOREIGN PATENTS OR APPLICATIONS

| | | | |
|---|---|---|---|
| 444,684 | 3/1936 | United Kingdom | 241/49 |
| 773,211 | 4/1957 | United Kingdom | 19/99 |

*Primary Examiner*—Dorsey Newton
*Attorney, Agent, or Firm*—William Anthony Drucker

[57] ABSTRACT

A method and apparatus for producing multilayer fibrous mats is provided which can form alternate short and long fiber layers continuously on a single forming endless wire cloth. The layers are brought together under the influence of suction air and are held together by interfiber bonds at their interfaces. The apparatus is composed of long fiber defibrators and a short fiber disperser unit placed above the forming endless wire cloth. First, a thin web of long fibers is formed on the forming wire cloth and then a short fiber mat is formed on top of the said long fiber web. At this point, the short fibers to a certain extent are pulled into and among the long fibers of the thin long fiber web by the use of suction air thus forming a long fiber layer, long-short fiber interface layer and a short fiber layer mat construction.

6 Claims, 8 Drawing Figures

MULTILAYER FIBROUS STRUCTURES

This application is a continuation-in-part application of our commonly assigned copending application Ser. No. 262,185 filed June 13, 1972 now U.S. Pat. No. 3,781,150.

This invention relates to a method apparatus for producing fibrous structures, more particularly to an improved method and apparatus for producing a multilayer mat or web from combination of short and long length fiber materials for use as non-woven fabrics.

The term "short fibers" as used herein includes typically woodpulp fibers having an average fiber length of 2–5 mm, while the term "long fibers" designates fibers of an average length of about 20–50 mm such as rayon, and nylon, polyester or other chemical or synthetic fibers and also includes cotton fibers.

Among conventional dry-laid non-woven manufacturing methods, the 100% rayon carding type is the most employed and produces material at the comparatively high speed of 100 meters per minute (M/Min). However, with this method, most of the fibers are aligned in the machine or production direction resulting in a disproportionate cross to machine direction tensile strength ratio, the former being only about 1/10 that to the latter. In order to increase this cross directional tensile stength, use of a greater volume of binder is necessitated resulting in a hardening of the normally soft rayon fibers, giving a rough sense of touch. As this method is mainly used to manufacture diaper facing material, it has in turn caused the criticism on the part of the consumer that disposable diapers are rougher than linen ones.

Rayon non-wovens that have been produced by random webbing contain a fairly uniform distribution of fibers laying in both cross and machine directions, with the result that there is little or no cross to machine direction strength ratio difference. This in turn results in a soft and pliant non-woven fabric because no additional binder is needed to cover the strength differential. A new problem is created thereby, however, namely that the rate of production is necessarily reduced to obtain the randomness of the web. For example, a 15 gram per square meter material can thus be produced at a speed of no more than 15 to 20 M/Min. which results in a production cost increase so that the random method of producing non-woven materials is not used for disposable consumer products.

Woodpulp fibers have been found to be an advantageous material for most sanitary products from the points of view of their relatively low price, their adequate moisture absorptivity and their bulkiness. On the other hand, woodpulp fibers are burdened by lack of strength due to their short fiber-length and their weakness is pronounced when they become wet in use. Therefore, sanitary products such as diapers and sanitary napkins made of woodpulp fibers are usually reinforced by suitable long fiber layers of facing material. Furthermore, woodpulp fibers short in fiber-length tend to give a rough, uncomfortable feel to the skin of the wearer.

All of the above disadvantages of woodpulp and similar short fiber materials may be overcome by combining them with long fiber materials such as chemical or synthetic fibers. The concept of combining or mixing short and long fibers is already known prior to this invention, and has been implemented by the process in which a sheet of short fiber material is laminated with a separately formed sheet or sheets of long fiber material and bonded together solely by added adhesives. This prior-art process has been found not entirely satisfactory in that for one thing, the long fiber sheet is necessarily thick, averaging in weight between 18 and 20 grams per square meter (gm/M$^2$) because long fibers are difficult in practice to process into sheets having a weight less than 15 gm/M$^2$, and for another thing, adhesives used to bond layers of short and long fiber sheets tend to form an intermediate film layer which results in stiffness of the product as a whole.

It is also contemplated that the methods used to mix the two fiber types are to defibrate both the woodpulp and the rayon fibers with a single lickerin roll, or defibrate them separately, thus forming a random web while mixing the two fiber types together. The aim of mixing in rayon fibers is to increase the surface softness of the web material. However, when rayon and woodpulp fibers are mixed together, a comparatively high rayon mix content of 20 to 30% of the total web weight is necessary to give such aimed-at surface quality. The rayon fibers within the web or on the backside do not of course contribute in realizing this objective yet increase the cost of the material product. In ths case, too, requiring randomness of the web will exert a strong influence on limiting the productivity of the process.

Whereas, it is an object of the present invention to provide a multilayer fibrous mat formed of short and long fiber materials which is free of the above-noted disadvantages of the prior-art products.

A more specific object of the invention is to provide an apparatus for forming a short fiber layer and a long fiber layer or layers either simultaneously in a single stage of process or by separately depositing one or more layers of long fibers and thereafter forming a short fiber layer thereon, both layers in either case being held together by interfiber bonds at their interfaces, and thus producing a multilayer mat product with a maximum of yield and high economy. According to the invention, a relatively thin multilayer mat is made available by holding the long fiber layer to a weight of less than 5 gm/M$^2$.

The present invention is a process for forming what in essence is a two-layer sheet by air laying rayon to form a surface layer with the necessary softness and air laying woodpulp to make the under layer.

First, a thin, light-weight layer of long fibers, eg. rayon, is formed on an endless wire cloth. The long fiber layer preferably has a weight in the range of from about 2–10 gm/M$^2$, and most preferably less than about 5 gm/M$^2$. A woodpulp layer is then successively formed on the top of this rayon layer. The woodpulp layer has a weight in the range of from about 10 to 200 gm/M$^2$. To execute the formation of the woodpulp layer, a suction box is located under the endless wire cloth. A part of the woodpulp fibers are pulled into the rayon fiber layer by the suction, resulting in a rayon and woodpulp mixed layer between the all-rayon and all-woodpulp layers. When the rayon layer is in the range of about 2 gm/M$^2$, the surface layer is actually a mixture of both fiber types and corresponds in touch and feel to homogeneous mix material with about 25% rayon content, and at around 5 gm/M$^2$ it becomes equivalent to an all-rayon web in its surface qualities. Taking a 50 gm/M$^2$ sheet as an example, a 3 gm/M$^2$ rayon surface layer is 6% of the whole, considerably less than that of homogeneous mix with over 25% rayon fiber content while still providing the same surface quality.

The lickerin method is the main method in use for random webbing rayon and other long fibers. As mentioned above, the productivity of this and other methods of random webbing is low and is proving to be a problem. In this invention, random webbing of 3 gm/M² of rayon with 1 lickerin unit is attained at a speed of 100 M/Min.

A certain degree of but allowable complication of the apparatus cannot be avoided when more than one lickerin unit is used, but 160 M/Min. of production speed at a rayon weight of 5 gm/M² can be obtained by installing 2 lickerin units, thus eliminating the problem caused by the low speed necessitated with the use of long fibers. High productivity can thus be achieved with this invention, balancing the producing capabilities of the long fiber laying units with that of the short fiber laying unit.

Again with the carding non-woven method, mentioned above, 15 gm/M² of rayon is about the smallest amount that can be actually taken off the doffers, resulting in great difficulties in making a 2 gm to 5 gm/M² sheet of rayon independently. Even should a separated made rayon sheet and woodpulp sheet be laminated together, the tensile strength and in particular the elongation of the two layers of sheet are different so that delamination easily occus, which means that the rayon which is the surface layer of the product will peel off during use.

In regard to the effectiveness of binder, particularly with the spray method, the distribution of the binder volume tends to change at the cross-section of the sheet, greater amounts of binder adhering to the surface layer and lesser amounts penetrating inside the web. Rayon and other long fiber webs are easily strengthened because their length offers more points of contact one with another and this invention also makes use of this fact. The surface layer is comprised of rayon fibers and also retains the greatest amount of binder, making the effectiveness of using binder optimum, while reducing the actual necessary amount of binder itself in order to achieve a given strength. Also, as the rayon surface layer is thin, and there is a rayon and woodpulp mixed layer, there is little difference between the layers in strength and elongation, thus making it a non-woven material difficult to delaminate.

These and other objects and features of the invention will appear clear from the following detailed description taken in conjunction with a specific embodiment and with reference to the accompanying drawings in which.

Figure 6:
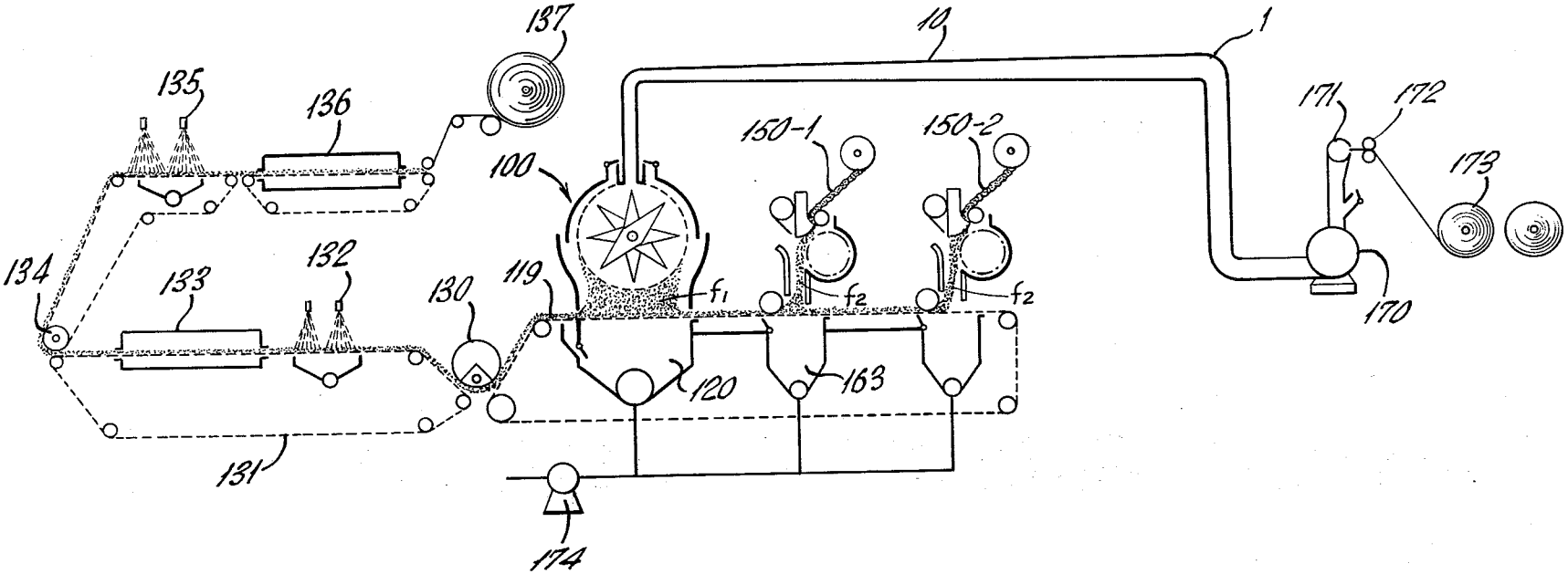
FIG. 6 is a schematic illustration of the general arrangement of a mat forming apparatus embodying the present invention.
Figure 7:
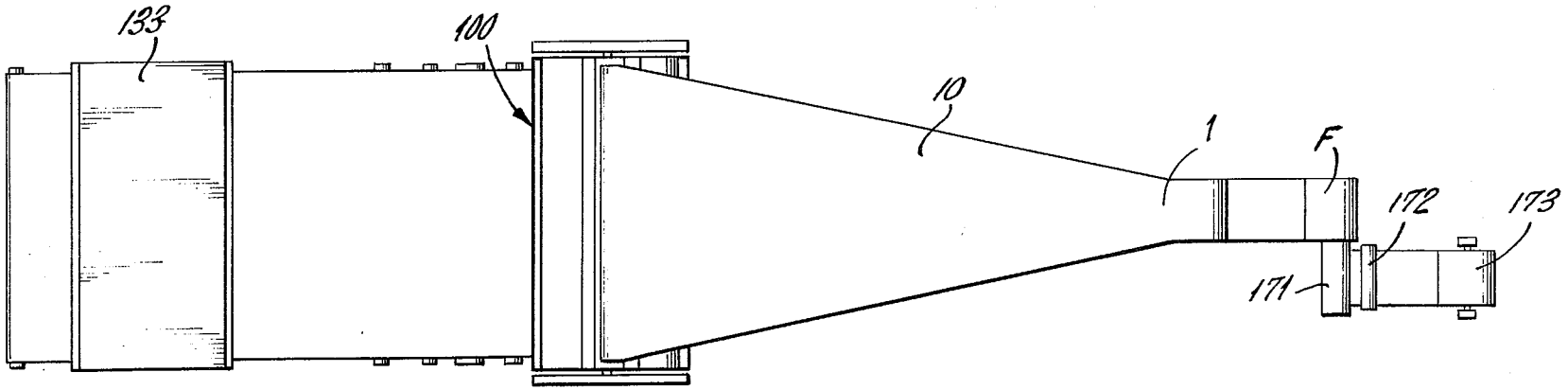
FIG. 7 is a partial top view of FIG. 6 showing the configuration of part of the apparatus.

As is illustrated in FIGS. 6 and 7 a supply of pulp is provided in the form of a roll 173 which is fed into a shredder 171 through feed rolls 172. Although rolls of pulp are the preferred source, the present invention also contemplates that the pulp may be provided in the form of baled sheets of pulp fiber. As is described in more detail hereafter, shredder 171 functions to break the supply of pulp into chunks, which are then disintegrated into fibers and flocks of fibers by a refiner 170. The disintegrated fibers are then suspended in an air stream and transported along a flared duct 10 to a disperser 100 which distributes the short fibers onto the layer of long fibers, as will also be hereafter explained.

For purposes of example, shredder 171 may be similar to that disclosed in Kroyer, United Kingdom Pat. No. 1,224,325, wherein a sheet of pulp is fed along a shear plate into a housing, wherein a plurality of rotating blades engage the leading edge of the pulp sheet to cut chunks or small pieces from the sheet. Such chunks of shredded pulp may have an average size of from about 1 to 2½ centimeters.

The thus formed shredded chunks of pulp are transported to refiner 170 through a vertical duct by the combined action of gravity and suction from fan F, and are disintegrated into elementry fibers by refiner 170, which may for purposes of example be similar to a conventional hammer mill. The fiber outlet or refiner 170 is relatively narrow in width, as for example 0.3 meter or less.

A fan F is provided at the upstream end of duct system 10 for transporting the fibers from refiner 170 to disperser 100. The fan may be located within the refiner 170 or provided as a separate unit. The width of disperser 100 is substantially greater than the width of the fiber outlet of refiner 170, and may be in excess of 2 meters. Duct system 10 flares from the fiber outlet of refiner 170 to the fiber inlet of disperser 100, and to provide for substantially constant air velocity within duct 10, the duct is tapered inversely in both cross-sectional directions so as to provide a uniform cross-sectional area throughout the length of the duct system and therefore maintains substantially constant velocity of the air stream in the duct system.

As is shown in FIG. 6, duct system 10 includes at least one bend 1 of about 90° between refiner 170 and disperser 100. This bend tends to deflect the fibers suspended in air from their initial trajectory in the center of the duct towards the duct sides, and with the flare of the duct uniformly the fibers substantially evenly throughout the cross-sectional area of the duct. This insures that the fibers will be substantially unformly distributed across the width of the duct 10 as they approach the fiber inlet of disperser 100.

The short fiber disperser unit 100 is designed to eliminate any goups of fibers which may have flocked together during passage along the duct 10, and to disperse the finely separated short-length fibers $f_1$ of wood pulp upon an endless wire conveyor 119. Disperser 100 is essentially comprised of a plurality of defibrating elements or blade runners 101 operatively associated with an elongate cylindrical separating wall 102 hereinafter described. A preferred form of blade runner 101, as better shown in FIG. 3 has an annular core portion 103 defining a circular hole 104 for insertion through a horizontally mounted rotary shaft 110 and generally triangular blade portions 105 extending symmetrically on opposite sides of the core 103. Each blade runner 101 should be relatively thin, having a thickness in the order of about 1–5 millimeters, preferably 3 millimeters thick. The triangular portion 105 in particular should be as light in weight and tapered off as sharply as strengthwise tolerable with a view to maintaining a high critical number of revolutions for a relatively long shaft or rotor on which the blade runners are mounted. For this purpose, a light metal such as aluminum may be advantageously used for these blade runners 101. To further reduce the weight of the blade runner, there are provided therein punchd-out holes 140. Also importantly, the blade runner 101 should be flat and rectilinear in its entire plane so as to minimize the resistance to air during its rotation within a dispersing chamber 114. Blade runners with curved or otherwise distorted plane are prone to produce a fan action in the air stream which would lead to the formation of undesirable fiber clots or nodules as experienced with the conventional hammer mill, paddle or brush type defibrators and consequently to imperfections in a finished mat.

A number of these blade runners 101 are superimposed one upon another axially at random angles and radially extending in close proximity to the inner face of the separating wall 102 and are thus fixedly mounted on the rotary shaft or rotor 110. Importantly, the blade runners 101 should be stacked one upon another with their triangular portions 105 oriented in predetermined random directions so as not to be in alternately uniform angular relation as will form a spiral arrangement or a screw-thread contour which would tend to align the air stream in an axial direction and swerve the fibers towards an end of the wall 102. The rotor 110 is driven by a motor (not shown) at a high speed.

The elongated cylindrical separating wall 102 is preferably 1.5–3 millimeters thick and is provided with foramens or openings 112 uniformly distributed substantially over its entire circumferential areas other than the inlet portion through which aforementioned fibers and flocks of fibers are fed. The separating wall being thus provided with a maximum of operating areas will advantageously permit of a rate of fiber flock separation and fiber dispersion for greater than ever achieved by any prior-art devices. The openings 112 are preferably 3–5 millimeters in diameter, most preferably 4.5 millimeters in diameter and spaced by a distance S of preferably 4.5–7 millimeters, most preferably 6.5 millimeters. It has now been found that the total area of openings 112 or their occupancy in the separating wall 102 is preferably in the range of 30–50%. A greater foraminous area would fail to sift separated fibers through the wall and would allow undispersed fiber flocks to escape therethrough. Conversely, smaller foraminous area would prevent separated fibers from passing through the wall. The sifting operation of the wall 102 is related to the peripheral speed of the blade runners 101 and to the diameter of the openings 112. For the above-specified diameters of openings 112, the peripheral speed of the blade runners 101 should be preferably 50–80 meters per second. Lower peripheral speeds would give very little sifting action and allow fiber flocks to slip out through the openings 112. Conversely, higher peripheral speed would invite increased fan action.

The separating wall 102 is elongated to be about 3,000 millimeters long according to one illustrated embodiment of the invention and should importantly be devoid of any interposed ribs or supports because these supports tend to disturb the fiber-carrying air stream and cause flock formation.

Figure 3:
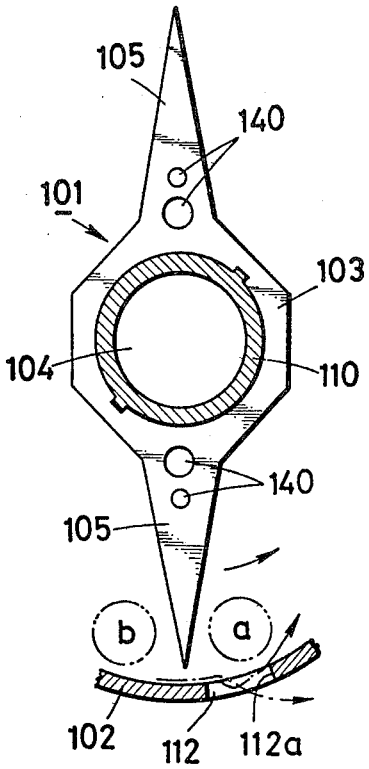
FIG. 3 is an enlarged plan view of a defibrator element or blade runner employed in accordance with the invention and shown as operatively associated with a separating wall.
Figure 4:
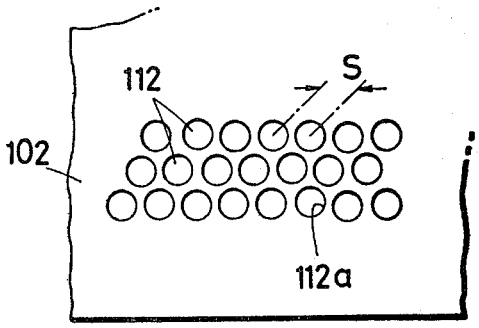
FIG. 4 is an enlarged fragmentary plan view of a separating wall employed in accordance with the invention.
Figure 5:
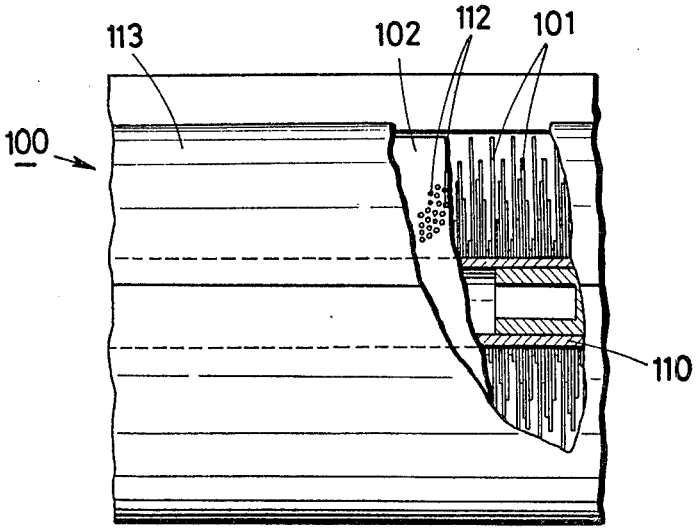
FIG. 5 is a partly longitudinally sectional view of FIG. 2.

The blade runners 101 have their tips disposed in close proximity to the inner face of the separating wall 102, a distance of 10 mm or less, and the manner in which they cooperate with this separating wall is ilustrated in FIG. 3, from which it will be understood that a "breathing action" takes place in the air current moving circumferentially closely along the inner face of the separating wall as each blade runner rotates in close approach to the wall. More specifically, a circumferential movement of each blade runner in a counterclockwise direction develops a positive pressure at the region (a) forward of the runner and a negative pressure at the region (b) rearward of the runner, with the results that the openings 112 at the region (a) exhale the air which entrains dispersed fibers immediately upon separation and moves them out through the openings of the wall, while the air current at the region (b) is inhaled and directed inwardly towards the blade runners. This breathing action of the openings 112 caused by the close proximity of the blade tips to the separating walls serves to eliminate the tendency of fibers being entrapped and plugging up the openings. In such instances, flocks or fibers that have not been separated to elementary fibers are caught by the tips of the blade runners or carried on the air current over past the openings without being sifted therethrough and are thus drawn back inwardly of the wall. This is because the flocks have greater inertia as against their air-resistance than separated individual fibers. Unseparated fibers or flocks are therefore continued to rotate with the moving air current or with the rotating blade runners until they are completely defibrated or dispersed into individually separated fibers on impinging contact with the blades of the runners 101 and also with the peripheral edges **112*a* of the openings 112** in the wall that function as stationary blades. This allows the disperser unit to be supplied with high volumes of fiber.

Designated at 113 is a generally cylindrical casing disposed in surrounding relation to said separating wall 102 and defining therewith an annular dispersing chamber 114 in which separated fibers are dispersed in controlled volumes of air. The casing 113 is provided with elongate slits or apertures 115 communicating with the atmosphere and extending axially on opposite sides and extending the full width thereof. These apertures are provided for maintaining a constant supply of atmospheric air with which to militae by a sweeping action against the tendency of dispersed fibers to collect and flock at the inner wall of the casing 113. This tendency to flock is progressively greater toward the bottom of the casing. The volume of air may be controlled by regulating the size of apertures 115. This can b accomplished by the use of a damper (not shown) or by moving the bottom portin of the casing 113 toward or away from the upper portion of the casing to decrease or increase the size of apertures 115. The number of such aperture sets located on opposite sides of the casing may be increased for the same reasons.

For similar purposes and for diluting the air/fiber mixture in the dispersing chamber 114, there are provided at the top and extending along the full length of said chamber air intakes 116 and dampers 117, associated therewith for introducing such volumes of air as are required to maintain a desired volumetric ratio of air to fibers and at the same time providing an air current to sweep the fibers off the upper portions of the inner wall of the casing 113. The dispersed fibers screened through the separating wall 102 are thus prevented from flocking together in the dispersing chamber 114 by these sweeping air layers established along the inner wall of the casing 113. In order to further ensure that fibers are prevented from becoming agglomerated into flocks within the dispersing chamber 114, it is to be noted that the radius of this casing is greater progressively towards a fiber outlet 118 so as to maintain a constant velocity of air throughout all regions of the chamber 114. To this end, there is also provided more fresh air at the counter-flow area, or the right half section as viewed in FIG. 7, of the dispersing chamber 114 than at the forward-flow area, or the left half section of the dispersing chamber 114. Thus the chambers 117' on the side of the casing where the air flows in a direction reverse to the rotation of the blade runners 101 should be held open wider than those dampers 117 positioned where the air flows in a direction forward to the rotation of the blade runners.

The casing 113 including both ends thereof must be made of transparent synthetic resin such as for example vinyl chloride and acrylic resins. The casing being transparent can be utilized to inspect the conditions of fiber-entraining air currents within the dispersing chamber 114 so as to readily adjust the dampers 117, and aperture 115 as desired. Another important advantage of the casing being made of the above exemplified plastic materials is that it has a mirror-like smooth contact surface which does not reach the dew point as easily as does any metal and can be charged equipotentially with separated fibers sifted from the wall 102 so that the fibers are prevented from being statically collected at the inner wall of the casing 113.

The casing 113 is provided with a downwardly directed outlet or deposit opening 118 elongated substantially to full length of the casing for depositing dispersed, separated fibers therethrough onto a moving endless wire conveyor 119.

Figure 1:
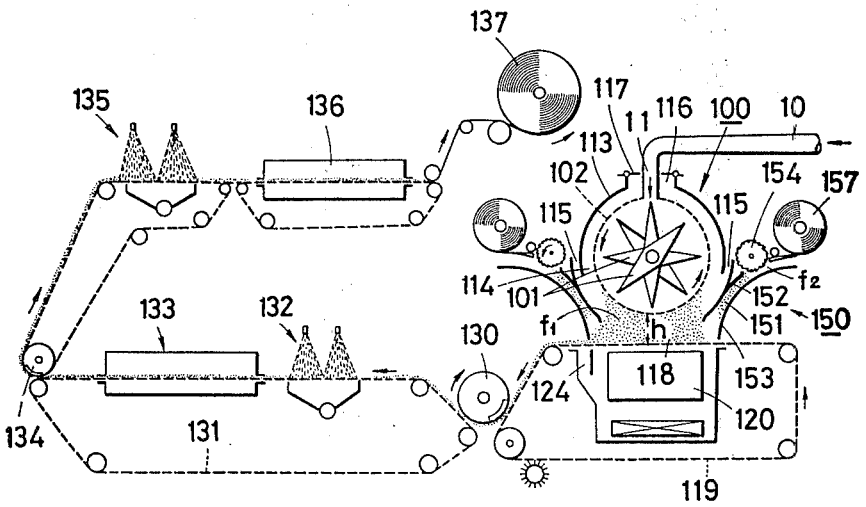
FIG. 1 is a schematic illustration of the general arrangement of a mat forming apparatus in accordance with ome embodiment of the invention.
Figure 2:
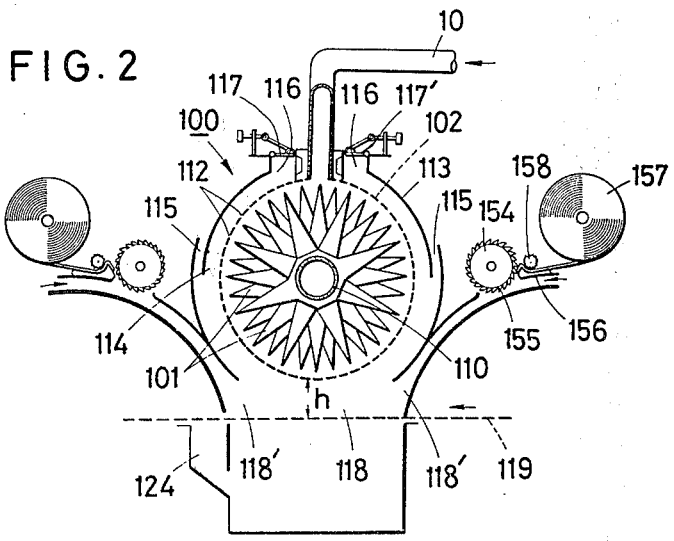
FIG. 2 is an enlarged cross-sectonal view of the important operating parts of the apparatus of the invention.

Provided in combination with the foregoing disperser 100 is a defibrator unit 150 for producing long fibers $f_2$ which unit is operatively associated with and extending to substantially full operating length of the disperser unit 100. The defibrator unit 150 is comprised of a funnel 151 constituted by an inner wall 152 and an outer wall 153 and communicating with the fibers outlet 118 for disintegrated short fibers $f_1$. The inner wall 152 of the funnel 151 is joined with the lower section of the casing 113 and has its upper edge disposed in close approach to a defibrator roll 154 having wound thereon a toothed clothing 155. Provided also in close approach to the periphery of the defibrator roll 154 and opposite to the upper edge of the inner wall 152 is a feed plate 156 commonly known as a dish plate having one edge disposed in coacting relation to the toothed wire 155 for defibrating a long-fiber forming lap 157 which is advanced by a feed roller 158. As shown in FIGS. 1 and 2, the lap 157 is fed against and caught between the wire 155 and plate 156 and combed by the toothed clothing 155 into finely separated individual fibers $f_2$ of long length in contrast to short fibers $f_1$ produced by the disperser unit 100. The thus separated long fibers $f_2$ flow downwardly through the funnel 151 and deposit themselves on the moving conveyor 119 to form a first outer layer thereon. As the conveyor 119 further advances in the direction of the arrow past an outlet 118' of long fibers $f_2$,it receives disintegrated short fibers $f_1$ deposited as a second or center layer on the previously formed first long fiber layer. In which instance, it is to be noted that under the influence of suction produced by a suction box 120 the disintegrated short fibers $f_1$ tend to grip and form an interfiber bond with the long fibers $f_2$.

According to the embodiment of FIGS. 1 and 2, there is provided an additional defibrator unit in a symmetrical position for forming a long fiber third layer over the second or center short fiber layer. Thus, the center layer may be sandwiched between the first and third layers, if desired. The first and third layers may be formed of different fibers, e.g. the first layer may be formed of rayon fibers, while the third layer may be formed of polyester fibers, and the fibers of each such layer in turn may be of different characteristics and sizes.

Figure 8:
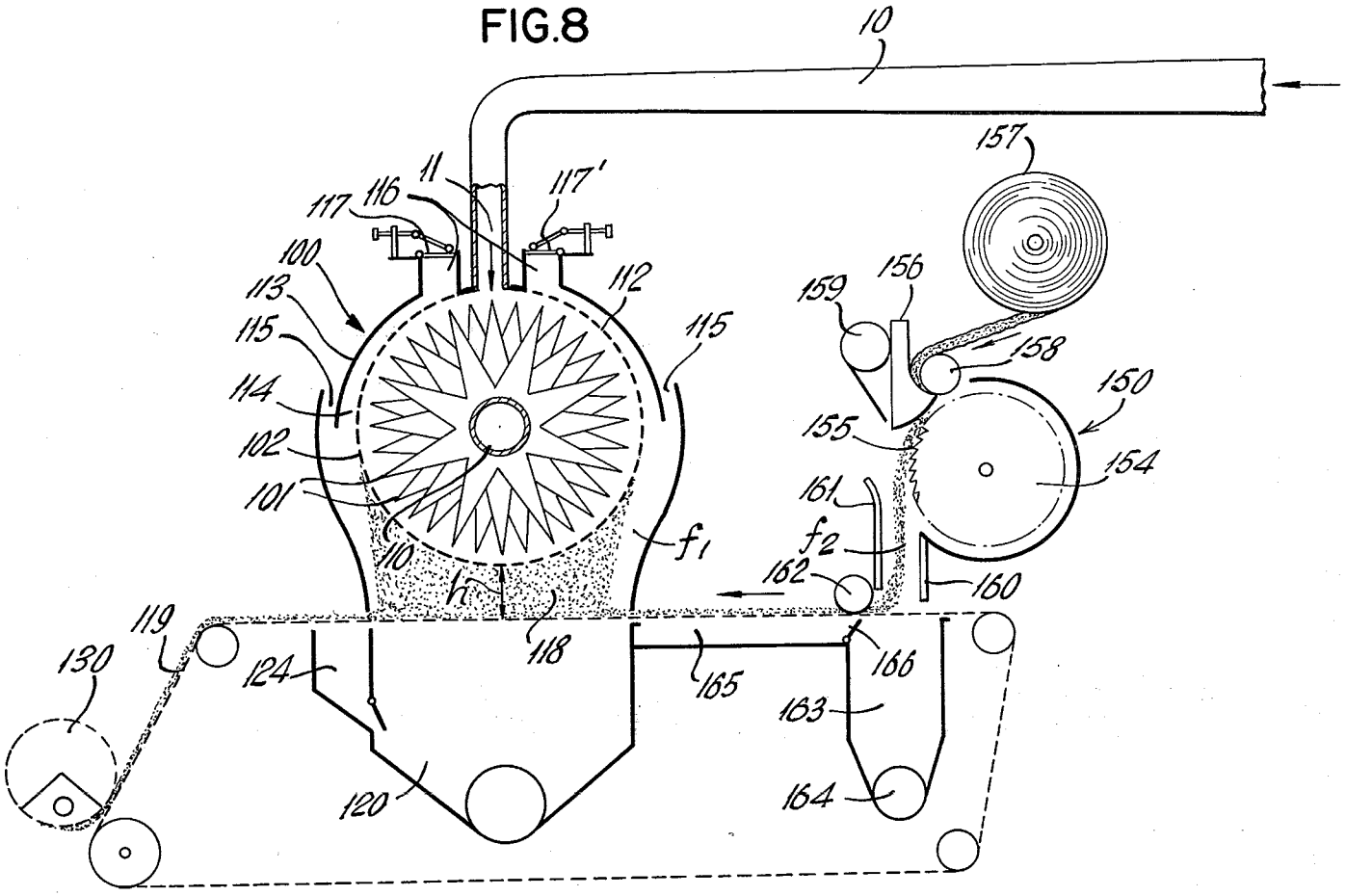
FIG. 8 is an enlarged cross-sectional view of the important operating parts of the apparatus of the invention.

Referring now to FIGS. 6 and 8, further embodiments of the present invention are illustrated therein which are similar to that described above, except that the long fibers for the mat are deposited at a location spaced from the short fiber disperser 100. Because of the similarities between the various embodiments, similar reference numerals have been utilized in FIGS. 6, 7, and 8 to designate parts that correspond to similar components of the previously described embodiments.

Referring specifically to FIG. 8 a long fiber defibrator 150 is positioned adjacent to short fiber disperser 100 above endless wire conveyor 119. A long fiber lap 157 that has previously been suitably opened by carding or the like is fed between feed roll 158 and feed plate 156, and defibrated by a lickerin roll 154. The resulting individual long fibers are blown downwardly by an air flow emanating from an air knife 159 supported adjacent to feed plate 156, and are drawn downwardly by the suction of a suction box 163 positioned below air knife 159. The fibers are transported through a chute formed by spaced plates 160 and 161 disposed below air knife 159, and the individual long fibers are pulled onto the endless wire 119 by the suction of the suction box 163 to form a thin long fiber mat having a weight in the range set forth above. The velocity of the air flow from the air knife is higher than the peripheral velocity of the lickerin roll.

The mat thus laid and formed on the endless wire 119 is conveyed to the short fiber disperser 100 while being protected from being blown back up by a seal roll 162 that is positioned in sealing relationship with the lower end of chute wall 161. The suction box 163 includes an extension section 165 which extends to the short fiber disperser 100, and the suction box extension section 165 holds the long fiber layer on the upper surface of the endless wire 119 as it is transported to the short fiber defibrator 100. Short fibers are then distributed on the long fiber layer in the manner described above under the influence of suction from suction box 120 so that at least some of the short fibers tend to grip and form an interfiber bond with the long fiber layer.

As shown in FIGS. 6 and 7, the duct system 10 tapers in the length direction and is flared in the width direction and has a constant cross sectional area from the refiner 170 to the disperser 100. This maintains a constant velocity of the air fiber mixture between the refiner and the disperser.

With the reference to FIG. 6 an arrangement is shown therein that is similar to that of FIG. 8, with the exception that two long fiber defibrators 150-1 and 150-2 are provided in spaced relationship with respect to short fiber disperser 100. As is clear from FIG. 6 separate long fiber layers will be deposited on endless wire 119 by each of the long fiber defibrator units, and such layers may have weights in the range described above. While two such long fiber defibrator units have been shown in FIG. 6 the invention is not limited to any given number of such units, and more than two may be utilized, if desired. It should also be noted in FIG. 6 that a separate suction box 163 is provided for each of the long fiber defibrating units. A common suction fan 174 may be utilized to apply suction to each of the suction boxes 163 and to the suction box 120 for the short fiber disperser 100, although it is desired that the amount of suction be individually controllable for each of the suction boxes. While long fiber defibrators have been shown in FIGS. 6 and 8 only on the upstream side of the short fiber disperser, it should also be understood that long fiber defibrators may also be positioned on the downstream side of the short fiber disperser in instances where it is desired to produce a mat having long fibers at both faces thereof.

Suction box 120 opens to full dimension of the outlet 118 of the short fiber defibrator in each of the embodiments described above, and box 120 is situated a predetermined distance apart from the bottom of the separating wall 102. As the peripheral speed of the blades 105 is constant, the distance ($h$), between the lower end of the separating wall 102 and the wire conveyor 119 can be short without disturbing the formation of the mat by any fan action of the blades 105. The distance should be in the range of from 150 to 350 millimeters. Smaller distance will communicate the wind produced by rotating blade runners 101 to a mat forming plane of the wire conveyor and mar the mat formation. Conversely, greater distance will cause large eddy currents to occur beneath the separating wall which in turn causes fibers to flock and move sideways while being deposited. This tends to deteriorate the surface finish of the resulting mat as well as promote cross machine variations in the weight of the deposited mat.

Annexed with the main suction box 120 at a position upstream of the run of the wire conveyor is an auxiliary suction box 124 which is adapted to maintain a suction air current thereat to eliminate the tendency of the formed mat being disturbed by a draught of air occurring immediately upon departure of the wire conveyor from the system.

The fibrous mat or felt deposited in a multilayer form on the wire conveyor 119 is transferred by a suction pick-up roll 130 onto a further processing stage where the mat is finished in the known manner.

FIGS. 1 and 6 illustrate a preferred form of such finishing stage wherein the multilayer short and long fiber layer mat is transported on an endless conveyor 131 and introduced into a first adhesive applying unit 132 for receiving atomized adhesive on one surface of the mat. The mat is then passed through a first drying section 133 to dry and set the adhesive, and thereafter, the direction of travel of the mat is oriented as by a suction roller 134 so that the other or unbounded surface of the mat is exposed for receiving atomized adhesive at the second adhesive applying unit 135. The mat is thus processed similarly through the second drying section 136, and then is finally taken up on a mat roll 137.

What is claimed is:

1. Apparatus for forming and producing webs for non-woven uses which comprises: a long fiber defibrating unit comprising a lickerin roll, feed means to supply the lickerin roll with fibers, means disposed above said lickerin roll to assist the dispersement of said fibers by the centrifugal forces of the lickerin roll, and chute means to direct the dispersed long fibers, an endless conveying and forming wire associated with and receiving fibers from said chute means, an air suction box located beneath said wire and beneath said chute means associated with said wire; a short fiber defibrating unit comprising a shredder to shred woodpulp, a refiner fed by said shredder to disintegrate the shredded woodpulp into single fibers, a short fiber disperser operatively associated with said long fiber defibrating unit and comprising an elongate cylindrical separating wall having sifting openings uniformly distributed over substantially its entire circumferential areas, a duct conveying fibers from said refiner to said short fiber disperser, a rotary shaft journaled within said wall, dispersing means rotatably mounted on said shaft and operatively associated with said separating wall for separating undispersed short-length woodpulp fibers, which may have flocked together during conveyance along the duct, into finely dispersed elementary fibers; a casing disposed in surrounding relation to said separating wall and defining therewith an annular dispersing chamber having a downwardly directed fiber outlet for dispersed fibers, said casing flaring towards said fiber outlet and being provided on opposite sides thereof with an elongate aperture communicating with the atmosphere for introducing a volume of air into said chamber, and a damper and air intake provided in said dispersing chamber regulating the volumetric ratio of air to fiber within said chamber, said fiber outlet being open to said endless wire underlying said fiber outlet for the deposition thereon of dispersed fibers.

2. The apparatus of claim 1 in which said dispensing means comprises a plurality of thin blade runners of uniform thickness superimposed one upon another at random angles and radially extending in close proximity to the inner face of said separating wall.

3. The apparatus of claim 2 in the distance between the ends of said blade runners and the inner face of said separating wall is less than 10 millimeters.

4. The apparatus of claim 2 in which said blade runners comprise an annular core portion and substantially triangular blade portions extending symmetrically on opposite side of said core portion.

5. The apparatus of claim 1 in which there is an additional long fiber defibrating unit located downstream of the short fiber disperser to deposit a layer of long fibers on the surface of the previously deposited layer of short fibers.

6. The apparatus of claim 1 in which said casing is made of a transparent plastic material.

* * * * *